US011982051B2

(12) United States Patent
Weissenberger et al.

(10) Patent No.: US 11,982,051 B2
(45) Date of Patent: May 14, 2024

(54) TEMPERATURE-CONTROLLED DELIGNIFICATION OF BIOMASS

(71) Applicant: SixRing Inc., Calgary (CA)

(72) Inventors: Markus Weissenberger, Calgary (CA); Emhemmed Youssef, Calgary (CA); Markus Pagels, Calgary (CA)

(73) Assignee: SixRing Inc., Calgary (CA)

( * ) Notice: Subject to any disclaimer, the term of this patent is extended or adjusted under 35 U.S.C. 154(b) by 0 days.

(21) Appl. No.: 17/807,179

(22) Filed: Jun. 16, 2022

(65) Prior Publication Data

US 2022/0412001 A1 Dec. 29, 2022

(30) Foreign Application Priority Data

Jun. 18, 2021 (CA) ..... 3122786

(51) Int. Cl.
*D21C 3/00* (2006.01)
*D21C 3/04* (2006.01)

(52) U.S. Cl.
CPC ..... *D21C 3/003* (2013.01); *D21C 3/04* (2013.01)

(58) Field of Classification Search
CPC ..... D21C 3/003; D21C 3/04
See application file for complete search history.

(56) References Cited

U.S. PATENT DOCUMENTS 5,234,466 A * 8/1993 Sargent ..... D21H 21/04 8/185
5,248,389 A * 9/1993 Heimburger ..... D21C 9/1036 162/76
2007/0277947 A1* 12/2007 Nguyen ..... D21C 9/1036 162/70
2015/0361616 A1* 12/2015 Essaddam ..... D21C 3/003 162/73
2017/0210827 A1* 7/2017 Nelson ..... D21C 9/002

FOREIGN PATENT DOCUMENTS

EP 801170 A1 * 10/1997 ..... D21C 9/1036

OTHER PUBLICATIONS

English translation of EP 0801170A1 supplied by Espacenet (Year: 2023).*

* cited by examiner

*Primary Examiner* — Eric Hug
*Assistant Examiner* — Elisa H Vera
(74) *Attorney, Agent, or Firm* — PCFB, LLC; Justin K. Flanagan

(57) ABSTRACT

A process to delignify biomass, said process comprising the steps of:

providing a vessel;

providing biomass comprising lignin, hemicellulose and cellulose fibers into said vessel;

providing a aqueous acidic composition comprising a sulfuric acid component;

providing a peroxide component;

exposing said biomass to said sulfuric acid component and peroxide component, creating a reaction mass;

allowing said sulfuric acid component and peroxide component to come into contact with said biomass for a period of time sufficient to a delignification reaction to occur and remove over 90 wt % of said lignin and hemicellulose from said biomass; and controlling the temperature of the delignification reaction to maintain it below 55° C.

13 Claims, 7 Drawing Sheets

TEMPERATURE-CONTROLLED DELIGNIFICATION OF BIOMASS

RELATED APPLICATIONS

This application claims priority to Canadian Patent Application No. 3,122,786, titled "Temperature-controlled Delignification of Biomass," filed on Jun. 18, 2021, which is hereby incorporated by reference in its entirety.

TECHNICAL FIELD

The invention herein discloses the novel process for the delignification of lignocellulosic biomass (such as found in wood, trees, grasses, agricultural waste, and waste paper) under temperature controlled conditions.

BRIEF DESCRIPTION OF THE FIGURES

Features and advantages of embodiments of the present application will become apparent from the following detailed description and the appended figures, in which.

BACKGROUND

Figure 1:
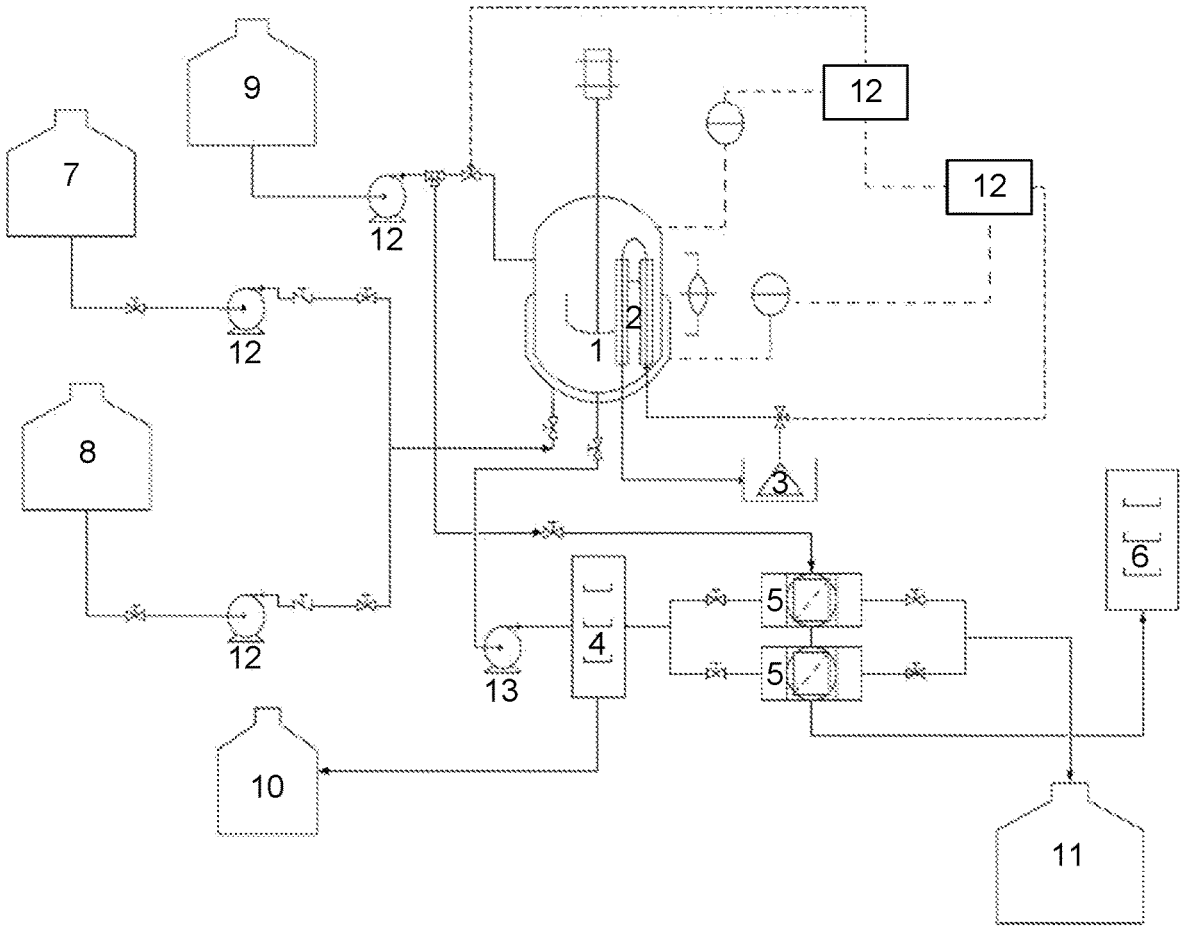
FIG. 1 illustrates the flow diagram of the process according to a preferred embodiment of the present invention using a single reactor.

Petroleum- or fossil fuel-based products include a vast array of products, as surfactants, pharmaceuticals, plastics and elastomers which are abundant in all aspects of manufacturing consumer products and fuels which are used to power vehicles, homes and industries. Climate change and environmental pressures are forcing society to find alternatives to fossil fuels and petroleum-based products. A well-known source for non-petroleum-based products is lignocellulosic biomass. This is the single most abundant source of carbon-neutral organic materials on the planet and contains most of the required compounds to sustain multiple industries including, but not limited to, energy production, chemicals, food, pharmaceuticals, concrete, various manufacturing and agriculture applications.

There are billions of tons being produced by biosynthesis every year. However, to efficiently separate the three components of lignocellulosic biomass proves to be a challenge for it to be a strong and legitimate competitor or alternative to petroleum-based products. To benefit from lignocellulosic biomass and to be able to further use it, one must be able to separate out the lignin, from the hemicellulose and the cellulose. Cellulose is an abundant, high molecular weight natural fiber that possesses great strength and biodegradability. Depending on the feedstock, cellulose can make up from 30 to 60 percent or in some cases more of the plant material and is found in trees/forestry residue, algae, crops, municipal and industrial waste, and various plants.

Furthermore, due to cellulose encasement between lignin and hemicellulose, the efficient and commercially viable extraction of cellulose will depend greatly on the method and biomass source used during the extraction process. Many current and proposed processing methods may limit the use or alter the structural integrity of the cellulose resulting in a marginal yield and excessive processing costs. In general, cellulose extracted from plant materials contains both an amorphous region and a crystalline region.

It is widely agreed that the technical difficulties in the processes, which are currently inefficient, expensive and difficult to scale, of separating lignin and hemicellulose from the cellulose in the biomass is what prevents such technology from being a viable alternative for petroleum-based or fossil fuel products.

The first step in paper production and most energy-intensive one is the production of pulp. Notwithstanding water, wood and other plant materials used to make pulp contain three main components: cellulose fibers; lignin; and hemicelluloses. Pulping has a primary goal to separate the fibers from the lignin. Lignin is a three-dimensional polymer which figuratively acts as a mortar to hold all the fibers together within the plant. Its presence in finished pulp is undesirable and adds nothing to the finished product. Pulping wood refers to breaking down the bulk structure of the fibre source, be it chips, stems or other plant parts, into the constituent fibres. The cellulose fibers are the most desired component when papermaking is involved. Hemicelluloses are shorter branched carbohydrate polymers consisting of various sugar monomers which form a random amorphous polymeric structure. The presence of hemicellulose in finished pulp is also regarded as bringing no value to a paper product. This is also true for biomass conversion. The challenges are similar. Only the desired outcome is different. Biomass conversion would have the further breakdown to monocarbohydrates as a desired outcome while a pulp & paper process normally stops right after lignin dissolution.

There are two main approaches to preparing wood pulp or woody biomass: mechanical treatment and chemical treatment. Mechanical treatment or pulping generally consists of mechanically tearing the wood chips apart and, thus, tearing cellulose fibres apart in an effort to separate them from each other. The shortcomings of this approach include: broken cellulose fibres, thus shorter fibres and lignin being left on the cellulose fibres thus being inefficient or non-optimal. This process also consumes large amounts of energy and is capital intensive. There are several approaches included in chemical pulping. These are generally aimed at the degradation the lignin and hemicellulose into small, water-soluble molecules. These now degraded components can be separated from the cellulose fibres by washing the latter without depolymerizing the cellulose fibres. The chemical process is currently energy intensive as well as high amounts of heat and/or higher pressures are typically required; in many cases, agitation or mechanical intervention are also required, further adding inefficiencies and costs to the process.

There exist pulping or treatment methods which combine, to a various extent, the chemical aspects of pulping with the mechanical aspects of pulping. To name a few, one must consider include thermomechanical pulping (also commonly referred to as TMP), and chemi-thermomechanical pulping (CTMP). Through a selection of the advantages provided by each general pulping method, the treatments are designed to reduce the amount of energy required by the mechanical aspect of the pulping treatment. This can also directly impact the strength or tensile strength degradation of the fibres subjected to these combination pulping approaches. Generally, these approaches involve a shortened chemical treatment (compared to conventional exclusive chemical pulping) which is then typically followed by mechanical treatment to separate the fibres.

The most common process to make pulp for paper production is the kraft process. In the kraft process, wood chips are converted to wood pulp which is almost entirely pure cellulose fibers. The multi-step kraft process consists of a first step where wood chips are impregnated/treated with a chemical solution. This is done by soaking the wood chips and then pre-heating them with steam. This step swells the wood chips and expels the air present in them and replaces the air with the liquid. This produces black liquor a resultant by-product from the kraft process. It contains water, lignin residues, hemicellulose and inorganic chemicals. White liquor is a strong alkaline solution comprising sodium hydroxide and sodium sulfide. Once the wood chips have been soaked in the various chemical solutions, they undergo cooking. To achieve delignification in the wood chips, the cooking is carried out for several hours at temperatures reaching up to 176° C. At these temperatures, the lignin degrades to yield water soluble fragments. The remaining cellulosic fibers are collected and washed after the cooking step.

U.S. Pat. No. 5,080,756 teaches an improved kraft pulping process and is characterized by the addition of a spent concentrated sulfuric acid composition containing organic matter to a kraft recovery system to provide a mixture enriched in its total sulfur content that is subjected to dehydration, pyrolysis and reduction in a recovery furnace. The organic matter of the sulfuric acid composition is particularly beneficial as a source of thermal energy that enables high heat levels to be easily maintained to facilitate the oxidation and reduction reactions that take place in the furnace, thus resulting in the formation of sulfide used for the preparation of cooking liquor suitable for pulping.

Caro's acid, also known as peroxymonosulfuric acid ($H_2SO_5$), is one of the strongest oxidants known. There are several known reactions for the preparation of Caro's acid but one of the most straightforward involves the reaction between sulfuric acid ($H_2SO_4$) and hydrogen peroxide ($H_2O_2$). Preparing Caro's acid in this method allows one yield in a further reaction potassium monopersulfate (PMPS) which is a valuable bleaching agent and oxidizer. While Caro's acid has several known useful applications, one noteworthy is its use in the delignification of wood.

Other methods have been developed for pretreating lignocellulosic feedstocks. These pretreatment methods include dilute acid pretreatment, steam explosion ($CO_2$ explosion), pH-controlled water pretreatment, ammonia fibre expansion, ammonia recycle percolation (ARP), and lime pretreatment (Mosier et al. 2005; Wyman et al. 2005; Yang and Wyman 2008). One approach involves the concept of organosolv. Organosolv pulping is the process to extract lignin from ligocellulosic feedstocks with organic solvents or their aqueous solutions. Organosolv pulping has attracted interest since the 1970's because the conventional pulping processes, kraft and sulfite processes, have some serious shortcomings such as air and water pollution. Organosolv pretreatment is similar to organosolv pulping, but the degree of delignification for pretreatment is not expected/required to be as high as that of pulping. However, a drawback of organosolv pre-treatment is the high temperatures at which the processes are known to be carried out at, upwards of 100-250° C., often times in the range of 185-210° C. Such temperatures require high energy inputs.

Improved processes for delignification need to take into account environmental aspects as well as end-product generation. Ambient temperature processes (20-25 degrees Celsius) are highly desirable as they do not require energy intensive inputs. However, to carry out delignification operations at low temperatures and atmospheric pressure, strong acids are typically required. The strength of the acids used while sufficient to remove lignin present on the lignocellulosic feedstock, can be deleterious to the lignin as it decomposes it beyond any lignin monomers which would be useable in other industries or applications, but can also damage the cellulose being yielded and therefore fail in delivering useable products from said feedstock.

Biofuel production is another potential application for the kraft process. One of the current drawbacks of biofuel production is that it requires the use of food grade plant parts (such as seeds) in order to transform carbohydrates into fuel in a reasonably efficient process. The carbohydrates could be obtained from cellulosic fibers, by using non-food grade biomass in the kraft process; however, the energy intensive nature of the kraft process for delignification makes this a less commercially viable option. In order to build a plant based chemical resource cycle there is a great need for energy efficient processes which can utilize plant-based feedstocks that don't compete with human food production.

In addition to the recovery of cellulose, the recovery of lignin is increasingly important. Most conversion technologies relating to dissolved lignin use heat and metal catalysts to effectively break down lignin into low molecular weight aromatics which hold value for other uses/applications across industry. Some of the considerations to take into account when exploring various processes include: efficiency of the catalysts used; the stability of the catalysts; Catalyst selectivity; control of the condensation and repolymerization reactions of lignin. The condensation and repolymerization of lignin often yield products which cannot be broken down easily using the conventional approaches and therefore lose a tremendous amount of value in terms of future uses/applications in industry. The condensation and repolymerization of lignin have a direct impact on the recovery of target lignin products (such as low molecular weight phenolic compounds). Thus, avoiding the condensation and repolymerization reactions is critical in order to maximize the yields of the target products.

The lignin repolymerization has been a substantial concern during many stages of the process of the delignification of lignocellulosic biomass. Conventional fractionation process, namely biomass pretreatment, focuses on its effectiveness to remove lignin from biomass structure, generally employing acid or base catalysts. The resulting residual solid, mainly lignin, significantly undergoes irreversible repolymerization depending on the pretreatment conditions. This is an outcome which must be avoided in order to extract maximum value from a treatment which is geared at recovering both cellulose and lignin for future uses.

While the kraft pulping process is the most widely used chemical pulping process in the world, it is extremely energy intensive and has many drawbacks, for example, substantial odours emitted around pulp producing plants or general emissions that are now being highly regulated in many pulp and paper producing jurisdictions. In light of the current environmental challenges, economic challenges and climactic changes, along with emission fees being implemented, it is highly desirable to optimize the current pulping processes. In order to provide at least linear quality fibres without the current substantial detriment to the environment during the production thereof. Accordingly, there still exists a need for a composition capable of performing delignification on wood substance under reduced temperatures and pressures versus what is currently in use without requiring any additional capital expenditures.

Accordingly, there still exists a need for a composition capable of performing delignification on lignocellulosic biomass under reduced temperatures and pressures versus what is currently in use without requiring any major additional capital expenditures and adapted to preserve the lignocellulosic biomass constituents as much as possible for further applications. The inventors have developed an improved delignification process which is more in line with the increasing environmental constraints and regulations which are put in place by governments across the globe.

SUMMARY OF THE INVENTION

According to one aspect of the present invention, there is provided a process to perform a controlled exothermic delignification of biomass. The inventors have developed a process for the delignification of biomass without the need to input heat to drive the delignification reaction to completion. Rather, according to a preferred embodiment of the present invention, the compositions used in the process are capable of effecting the delignification of biomass using chemicals under ambient conditions (i.e. 17-40° C.) without turning the carbohydrates into carbon black. Moreover, while such compositions can also be used for other applications, it is noteworthy to point out that despite the fact that they contain sulfuric acid and peroxide, they present better handling qualities than conventional compositions comprising sulfuric acid and a peroxide component.

According to another aspect of the present invention, there is provided a process to perform a controlled exothermic delignification of biomass, said process comprising the steps of:

- providing a vessel;
- providing biomass comprising lignin, hemicellulose and cellulose fibers into said vessel;
- providing a aqueous acidic composition comprising a sulfuric acid component;
- providing a peroxide component;
- exposing said biomass to said sulfuric acid source and peroxide component, creating a reaction mass;
- allowing said sulfuric acid source and peroxide component to come into contact with said biomass for a period of time sufficient to a delignification reaction to occur and remove over 90 wt % of said lignin and hemicellulose from said biomass.

According to yet another aspect of the present invention, there is provided a process to delignify biomass, said process comprising the steps of:

- providing a vessel;
- providing biomass comprising lignin, hemicellulose and cellulose fibers into said vessel;
- providing a aqueous acidic composition comprising a sulfuric acid component;
- providing a peroxide component;
- exposing said biomass to said sulfuric acid source and peroxide component, creating a reaction mass;
- allowing said sulfuric acid source and peroxide component to come into contact with said biomass for a period of time sufficient to a delignification reaction to occur and remove over 90 wt % of said lignin and hemicellulose from said biomass; and
- controlling the temperature of the delignification reaction by addition of water into said vessel.

According to yet another aspect of the present invention, there is provided a process to delignify biomass, said process comprising the steps of:

- providing a vessel;
- providing biomass comprising lignin, hemicellulose and cellulose fibers into said vessel;
- providing a aqueous acidic composition comprising a sulfuric acid component;
- providing a peroxide component;
- exposing said biomass to said sulfuric acid source and peroxide component, creating a reaction mass;
- allowing said sulfuric acid source and peroxide component to come into contact with said biomass for a period of time sufficient to a delignification reaction to occur and remove over 90 wt % of said lignin and hemicellulose from said biomass; and
- controlling the temperature of the delignification reaction by controlling the addition of biomass into said vessel.

According to a preferred embodiment of the present invention, the temperature of the reaction mass is kept below 55° C. for the duration of the delignification reaction. Preferably, the temperature of the reaction mass is kept below 50° C. for the duration of the delignification reaction. Preferably, the the temperature of the reaction mass is kept below 45° C. for the duration of the delignification reaction. Preferably, the reaction temperature is controlled in the 30-45° C. range to achieve optimum reaction time, and at least 90% delignification. According to a preferred embodiment of the present invention, the temperature of the reaction mass is kept below 55° C. as a maximum upper temperature, as it has been noted that above this temperature the reaction tends to run away and becomes more difficult to control with external temperature controls. If the reaction temperature goes up too fast it can become necessary to add water to control or to kill the reaction. Preferably, the reaction temperature is kept between 30 and 45° C. and even more preferably from 35 to 40° C.

According to a preferred embodiment of the present invention, the initial temperature of the reaction mass is no more than 40° C. and does not exceed 55° C. for the duration of the delignification reaction. Preferably, the initial temperature of the reaction mass is no more than 35° C. and does not exceed 55° C. for the duration of the delignification reaction. More preferably, the initial temperature of the reaction mass is no more than 30° C. and does not exceed 55° C. for the duration of the delignification reaction. Preferably also, the initial temperature of the reaction mass is no more than 25° C. and does not exceed 55° C. for the duration of the delignification reaction.

According to a preferred embodiment of the present invention, the temperature of the reaction mass is controlled throughout the delignification reaction to subsequent additions of a solvent (water) to progressively lower the slope of temperature increase per minute from less than 1° C. per minute to less than 0.5° C. per minute.

According to another preferred embodiment of the present invention, the temperature of the mixtu reaction mass is controlled by an addition of a solvent (water) to reduce the slope of temperature increase per minute of the reaction mass to less than 1° C. per minute.

According to yet another preferred embodiment of the present invention, the temperature of the mixtu reaction mass is controlled by a second addition of a solvent (water) to reduce the slope of temperature increase per minute of the reaction mass to less than 0.7° C. per minute.

Preferably, the temperature of the reaction mass is controlled by a third addition of a solvent (water) to reduce the slope of temperature increase per minute of the reaction mass to less than 0.3° C. per minute.

Preferably, the temperature of the reaction mass is controlled by a fourth addition of a solvent (water) to reduce the slope of temperature increase per minute of the reaction mass to less than 0.1° C. per minute.

According to a preferred embodiment of the present invention, the kappa number of the resulting cellulose is below 10, preferably the kappa number of the resulting cellulose is below 4.2.

According to a preferred embodiment of the present invention, there is provided a process to delignify biomass using an aqueous acidic composition comprising: sulfuric acid; a heterocyclic compound; and a peroxide.

According to yet another aspect of the present invention, there is provided a process to perform a controlled exothermic delignification of biomass, said process comprising the steps of:

providing a vessel;

providing biomass comprising lignin, hemicellulose and cellulose fibers into said vessel;

providing a modified Caro's acid composition selected from the group consisting of: composition A; composition B and Composition C;

wherein said composition A comprises:

sulfuric acid in an amount ranging from 20 to 70 wt % of the total weight of the composition;

a compound comprising an amine moiety and a sulfonic acid moiety selected from the group consisting of: taurine; taurine derivatives; and taurine-related compounds; and a peroxide;

wherein said composition B comprises:

an alkylsulfonic acid; and a peroxide; wherein the acid is present in an amount ranging from 40 to 80 wt % of the total weight of the composition and where the peroxide is present in an amount ranging from 10 to 40 wt % of the total weight of the composition;

wherein said composition C comprises:

sulfuric acid;

a compound comprising an amine moiety;

a compound comprising a sulfonic acid moiety; and a peroxide;

exposing said biomass to said modified Caro's acid composition, creating a reaction mass;

allowing said modified Caro's acid composition to come into contact with said biomass for a period of time sufficient to a delignification reaction to occur and remove over 90 wt % of said lignin and hemicellulose from said biomass; and controlling the temperature of the delignification reaction to maintain it below 55° C. by a method selected from the group consisting of: adding water into said vessel; adding more biomass (than the initial amount) into said vessel; and using a heat exchanger.

According to a preferred embodiment of the present invention, the aqueous acidic composition combines both the sulfuric acid component and the peroxide component and, as such, comprises:

a modified Caro's acid composition selected from the group consisting of: composition A; composition B and Composition C;

wherein said composition A comprises:

sulfuric acid in an amount ranging from 20 to 70 wt % of the total weight of the composition;

a compound comprising an amine moiety and a sulfonic acid moiety selected from the group consisting of: taurine; taurine derivatives; and taurine-related compounds; and a peroxide;

wherein said composition B comprises:

an alkylsulfonic acid; and a peroxide; wherein the acid is present in an amount ranging from 40 to 80 wt % of the total weight of the composition and where the peroxide is present in an amount ranging from 10 to 40 wt % of the total weight of the composition;

wherein said composition C comprises:

sulfuric acid;

a compound comprising an amine moiety;

a compound comprising a sulfonic acid moiety; and a peroxide.

According to a preferred embodiment of the present invention, said sulfuric acid, said compound comprising an amine moiety and a sulfonic acid moiety and said peroxide are present in a molar ratio of no less than 1:1:1.

According to a preferred embodiment of the present invention, said sulfuric acid, said compound comprising an amine moiety and a sulfonic acid moiety and said peroxide are present in a molar ratio of no more than 15:1:1.

According to a preferred embodiment of the present invention, said sulfuric acid and said compound comprising an amine moiety and a sulfonic acid moiety are present in a molar ratio of no less than 3:1.

According to a preferred embodiment of the present invention, said compound comprising an amine moiety and a sulfonic acid moiety is selected from the group consisting of: taurine; taurine derivatives; and taurine-related compounds.

According to a preferred embodiment of the present invention, said taurine derivative or taurine-related compound is selected from the group consisting of: taurolidine; taurocholic acid; tauroselcholic acid; tauromustine; 5-taurinomethyluridine and 5-taurinomethyl-2-thiouridine; homotaurine (tramiprosate); acamprosate; and taurates; as well as aminoalkylsulfonic acids where the alkyl is selected from the group consisting of $C_1$-$C_5$ linear alkyl and $C_1$-$C_5$ branched alkyl. Preferably, said linear alkylaminosulfonic acid is selected form the group consisting of: methyl; ethyl (taurine); propyl; and butyl.

Preferably, said branched aminoalkylsulfonic acid is selected from the group consisting of: isopropyl; isobutyl; and isopentyl.

According to a preferred embodiment of the present invention, said compound comprising an amine moiety and a sulfonic acid moiety is taurine.

According to a preferred embodiment of the present invention, said sulfuric acid and compound comprising an amine moiety and a sulfonic acid moiety are present in a molar ratio of no less than 3:1.

According to a preferred embodiment of the present invention, said compound comprising an amine moiety is an alkanolamine is selected from the group consisting of: monoethanolamine; diethanolamine; triethanolamine; and combinations thereof.

According to a preferred embodiment of the present invention, said compound comprising a sulfonic acid moiety is selected from the group consisting of: alkylsulfonic acids and combinations thereof.

According to a preferred embodiment of the present invention, said alkylsulfonic acid is selected from the group consisting of: alkylsulfonic acids where the alkyl groups range from $C_1$-$C_6$ and are linear or branched; and combinations thereof.

According to a preferred embodiment of the present invention, said alkylsulfonic acid is selected from the group consisting of: methanesulfonic acid; ethanesulfonic acid; propanesulfonic acid; 2-propanesulfonic acid; isobutylsulfonic acid; t-butylsulfonic acid; butanesulfonic acid; iso-pentylsulfonic acid; t-pentylsulfonic acid; pentanesulfonic acid; t-butylhexanesulfonic acid; and combinations thereof.

According to a preferred embodiment of the present invention, said alkylsulfonic acid; and said peroxide are present in a molar ratio of no less than 1:1.

According to a preferred embodiment of the present invention, said compound comprising a sulfonic acid moiety is methanesulfonic acid.

According to a preferred embodiment of the present invention, in Composition C, said sulfuric acid and said a compound comprising an amine moiety and said compound comprising a sulfonic acid moiety are present in a molar ratio of no less than 1:1:1.

According to a preferred embodiment of the present invention, in Composition C, said sulfuric acid, said compound comprising an amine moiety and said compound comprising a sulfonic acid moiety are present in a molar ratio ranging from 28:1:1 to 2:1:1.

According to another preferred embodiment of the present invention, there is provided a process to delignify biomass using an aqueous acidic composition comprising:

sulfuric acid;

a heterocyclic compound; and wherein sulfuric acid and said a heterocyclic compound; are present in a molar ratio of no less than 1:1.

Preferably, the sulfuric acid and said heterocyclic compound are present in a molar ratio ranging from 28:1 to 2:1 More preferably, the sulfuric acid and heterocyclic compound are present in a molar ratio ranging from 24:1 to 3:1. Preferably, the sulfuric acid and heterocyclic compound are present in a molar ratio ranging from 20:1 to 4:1. More preferably, the sulfuric acid and heterocyclic compound are present in a molar ratio ranging from 16:1 to 5:1. According to a preferred embodiment of the present invention, the sulfuric acid and heterocyclic compound are present in a molar ratio ranging from 12:1 to 6:1.

Also preferably, said heterocyclic compound has a molecular weight below 300 g/mol. Also preferably, said heterocyclic compound has a molecular weight below 150 g/mol. More preferably, said heterocyclic compound is a secondary amine. According to a preferred embodiment of the present invention, said heterocyclic compound is selected from the group consisting of: imidazole; triazole; and N-methylimidazole.

According to an aspect of the present invention, there is provided a process to delignify biomass, such as wood using an aqueous acidic composition comprising:

sulfuric acid;

a heterocyclic compound; and a peroxide.

wherein the sulfuric acid and the heterocyclic compound are present in a mole ratio ranging from 2:1 to 28:1.

Preferably, according to an embodiment where water addition into the vessel is avoided to the greatest extent possible, the control of the delignification reaction is done by controlling the temperature of the mixture within the vessel and therefore, the exothermicity of the delignification, the reaction is controlled by slowly adding the biomass into the vessel containing the sulfuric acid component and the peroxide component and allowing the reaction to occur prior to the addition of more biomass material. Once the reaction of the first amount of biomass has substantially finished more biomass material is added, this additional material will react and will begin to delignify but the reaction will be tempered to a certain extent by the presence of the prior delignified material and thus, cause the second amount of biomass to react in a more diluted mixture and so on, for subsequent additions of biomass into the vessel. According to a preferred embodiment of the present invention, the temperature increase resulting from the delignification reaction (which is exothermic) is utilized to heat the reaction mixture to the desired 30-45° C. range. This coincides with the advanced temperature control system, which allows for self-sufficient heat generation.

According to an aspect of the present invention there is provided a process to perform a controlled exothermic delignification of biomass, said process consisting of:

providing a vessel;

providing biomass comprising lignin, hemicellulose and cellulose fibers into said vessel;

providing a aqueous acidic composition comprising a sulfuric acid component;

providing a peroxide component;

exposing said biomass to said sulfuric acid source and peroxide component, creating a reaction mass;

allowing said sulfuric acid source and peroxide component to come into contact with said biomass for a period of time sufficient to a delignification reaction to occur and remove over 90 wt % of said lignin and hemicellulose from said biomass.

DETAILED DESCRIPTION

Method for Controlling Biomass Exothermic Hydrolysis Reaction Temperature

According to a preferred embodiment of the present invention, the method provides steps to control the exothermic hydrolysis reaction temperature of biomass and biomass waste materials. The difficulty of dissolving cellulose and separating it from other biomass constituents i.e., lignin and hemicellulose makes it necessary to use strong acid and peroxide for separating lignocellulosic material. This makes the reaction highly exothermic, costly to control, and it represents a safety concern.

According to a preferred embodiment of the present invention, the method uses intermittent water injection at the reaction start cycle which suppresses the temperature increase potential, and provides a smooth, very well controlled, and predicted reaction. Initial results showed that the exothermic behavior of the reaction was suppressed completely through the reaction time, without any changes to the desired reaction products. Preferably, this method results in the complete transformation of the development of new processes based on renewable raw materials from biomass since it allows for a substantial reduction in capital cost, and increases the safety factor when performing biomass delignifiction when compared to conventional processes.

As illustrated in FIG. 1, the process according to a preferred embodiment of the present invention provides for a reactor (1) which is fed with an acidic composition contained in acid containment unit (7) through actuation of pump (12*a*) as well as a peroxide contained in a peoxide containment unit (8) through actuation of a pump (12*b*). Water is added as needed to the reaction vessel (1). The water is contained in a tank (9) and is fed to the reactor (1) through the actuation of a pump (12*c*). Preferably, the vessel may contain a heat-exchanger (2) to control the temperature inside the vessel (1) when the reactants are exposed to biomass. The heat exchanger (2) is fed a fluid which is circulated through a closed loop circuit comprising a chiller (3) to cool down the fluid. Upon completion of the delignification reaction, the biomass and sulfuric acid are removed from the vessel (1) and the sulfuric acid is recovered at the sulfuric acid recovery unit (4) while the remaining solution containing the delignified biomass (cellulose, lignin fragments and hemicellulose) are further separated at the filter section (5). The separated cellulose is sent to a dryer (6) while the remaining liquid stream containing the lignin fragments and hemicellulose is sent to a holding tank (11) for further processing. The sulfuric acid recovered at the sulfuric acid recovery unit (4) is subsequently sent to the recovered sulfuric acid tank (10) for recycling into the process. The process has a robust design to allow for small sale to large scale producers and hence, very versatile capital expenditure (CAPEX) options.

Figure 2:
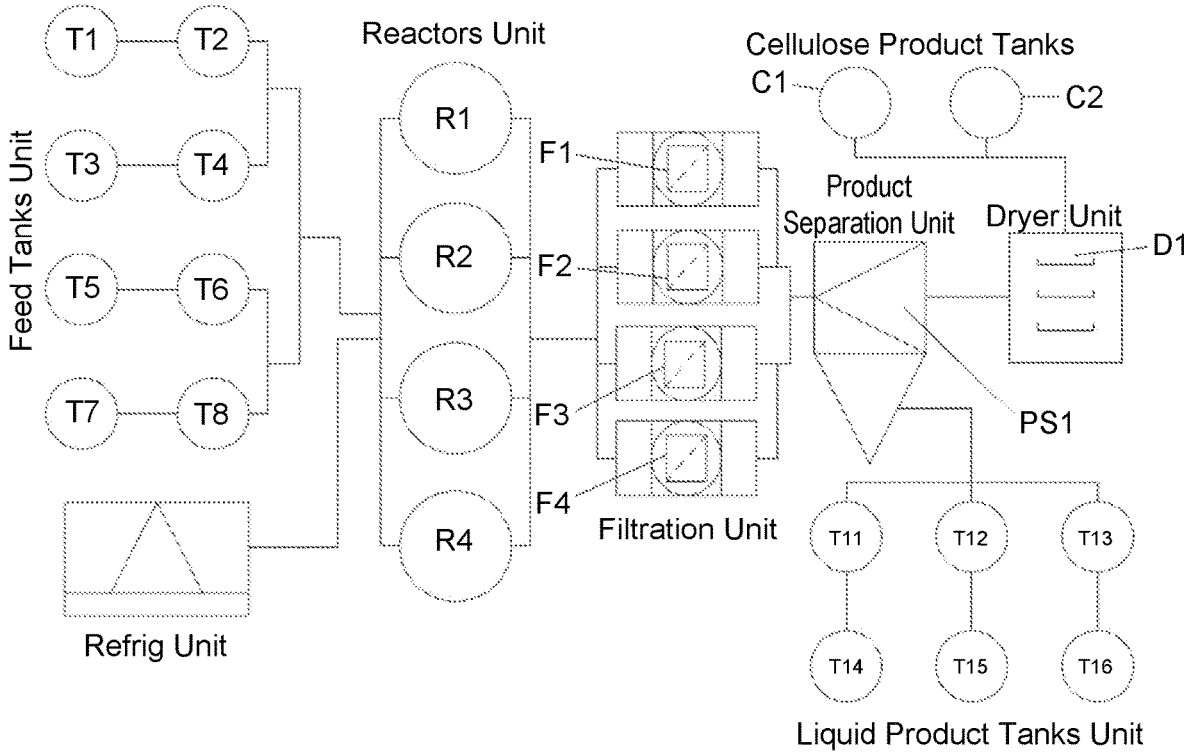
FIG. 2 shows a diagram set-up of a scaled-up process according to a preferred embodiment of the present invention for the production of 1 Metric ton/day of cellulose.

According to another preferred embodiment of the present invention as illustrated in FIG. 2, there is a plurality of tanks (T1, T2, T3, and T4) containing the modified sulfuric acid connected to a shared outlet which, in turn, can feed a number of reactor units (R1, R2, R3, and R4). As well, tanks (T5, T6, T7 and T8) containing the peroxide component are also fluidly connected to the reactors. A plurality of filters (F1, F2, F3, and F4) are found in the filtration unit section and into the product separation unit (PS1) where the stream is separated into a fluid stream which is flowed through to the liquid product tank collecting units (T11, T12, T13, T14, T15 and T16). The separated cellulose portion is sent to a dryer unit (D1) which dries and then sends the collected, dried cellulose product to cellulose product tanks (C1 and C2). It is expected that this set-up allows for the production of 1 metric ton of cellulose daily while being safe for operators and generating the cellulose through a controlled exothermic process where the heat of reaction is recovered for other uses.

According to a preferred embodiment of the present invention, allowing said sulfuric acid source and peroxide component to come into contact with said biomass for a period of time sufficient to a delignification reaction to occur and remove over 90 wt % of said lignin from said biomass; and controlling the temperature of the delignification reaction by addition of water into said vessel.

According to a preferred embodiment of the present invention, the biomass loading in the vessel for the delignification reaction can go up to 20 wt. %. According to a preferred embodiment of the present invention, the biomass loading in the vessel for the delignification reaction can go up to 15 wt. %. According to a preferred embodiment of the present invention, the biomass loading in the vessel for the delignification reaction can go up to 10 wt. %. Preferably, the biomass loading in the vessel for the delignification reaction can go up to 8 wt. %. More preferably, the biomass loading in the vessel for the delignification reaction can go up to 7 wt. %. According to a preferred embodiment of the present invention, the biomass loading in the vessel for the delignification reaction ranges from 4 to 6 wt. %.

According to a preferred embodiment of the present invention, the initial temperature in the vessel where the delignification occurs can be as low as 18-20° C. and still provide substantial delignification within a reasonable period of time. Preferably, the initial temperature in the vessel where the delignification occurs is 25° C. More preferably, the initial temperature in the vessel where the delignification occurs is 30° C. According to a preferred embodiment of the present invention, the initial temperature in the vessel where the delignification occurs ranges from 30 to 45° C. According to a preferred embodiment of the present invention, the initial temperature in the vessel where the delignification occurs ranges from 32 to 40° C.

According to a preferred embodiment of the present invention, the duration of the delignification reaction can last up to 24 hours. Preferably, the duration of the delignification reaction can last up to 12 hours. Preferably, the duration of the delignification reaction can last up to 6 hours. Preferably, the duration of the delignification reaction can last up to 4 hours. According to a preferred embodiment of the present invention, the duration of the delignification reaction takes about 3 hours. In some preferred embodiments the duration of the delignification reaction may take as little as 1.5 hours.

According to a preferred embodiment of the present invention, the chemicals used in a delignification reaction may be reused in a subsequent delignification and still maintain good delignification power. According to a preferred embodiment of the present invention, the chemicals used in a delignification reaction may be reused in a subsequent delignification by adding some of the peroxide component (referred to as "topping up") and still maintain good delignification power. The recycling of the chemicals used in the delignification provides several advantages with one of the most obvious one being eliminating the discharge of spent (or used) chemicals). According to a preferred embodiment of the present invention, the chemicals used in a delignification reaction may be reused several times by topping up with peroxide between each reaction.

Experimental Results

Temperature Control with Dilution

Figure 3:
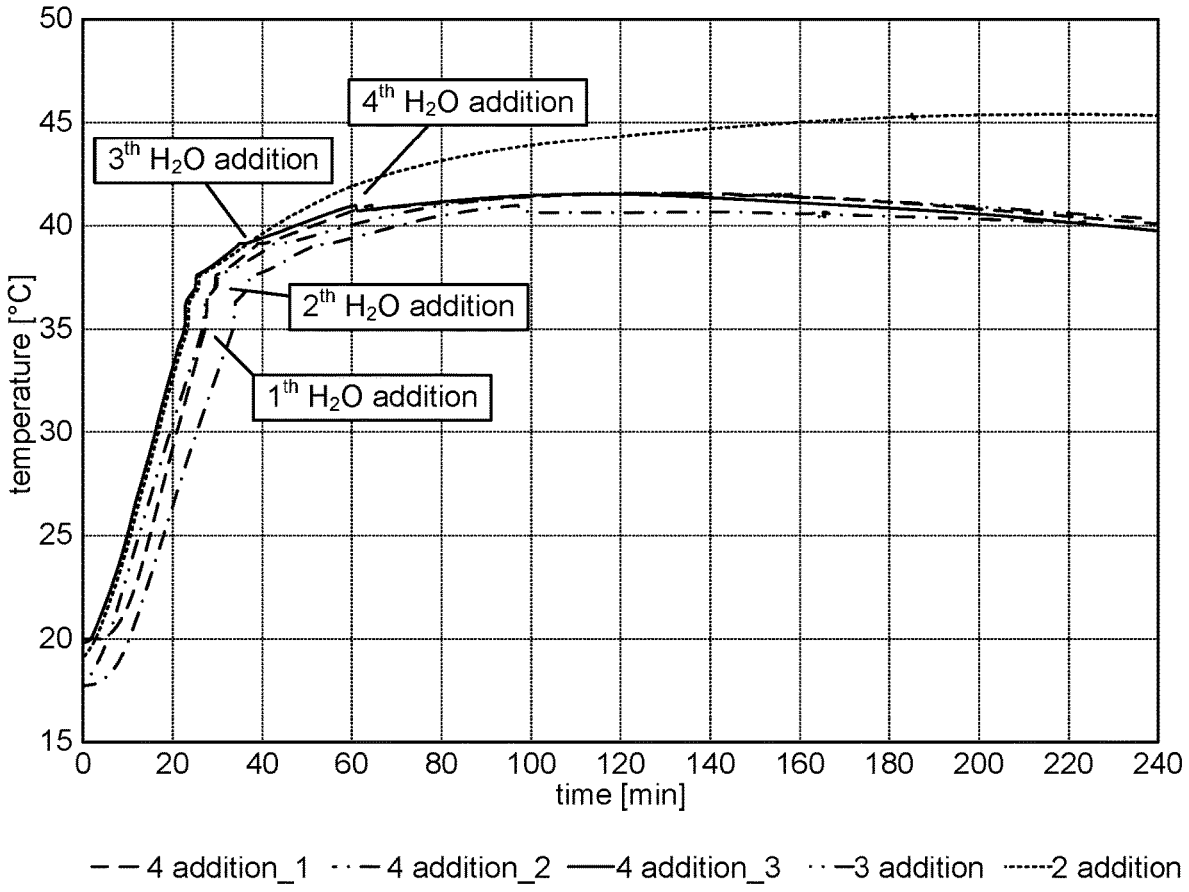
FIG. 3 is a graphical representation of the reactor temperature curves after the addition of biomass (t=0) for various delignification experiments.

In a 10 L glass reactor vessel 3,368 g $H_2SO_4$ (93%), 3,746 g $H_2O_2$ (29%), 576 g $H_2O$ and 310 g sulfamic acid were mixed to a molar ratio of 10:10:10:1. This modified acid/peroxide blend can be used to delignify lignocellulosic biomass to produce cellulose. When biomass (in the present examples, it consists of wood shavings at a 5% mass loading) is added to this blend at this scale the reaction is very exothermic and will run away. As best seen in FIG. 3, and to prevent a runaway reaction which would result in degradation of cellulose and keeping the mixture in control, small amounts of water (500 g each) are added to the reactor when the mixture reaches certain predetermined temperatures: 35° C. ($1^{st}$ addition of water); 37° C. ($2^{nd}$ addition of water); 39° C. ($1^{st}$ addition of water); and 41° C. ($4^{th}$ addition of water, until the temperature increase in the reactor is small enough to keep the reaction going, but not run away. In cases when too much water is added, the reaction stops and the biomass will not be delignified completely. No external cooling was applied in any of the experiments.

A series of five dilution experiments were run to determine the minimum amount of water that needs to be added in order to control the reaction mass without stopping the reaction by adding too much water at once. The first set of three were run under the same conditions with the same number of water additions to verify repeatability (4 additions of 500 ml). The only difference being the starting temperature depending on the room temperature in the lab as no external temperature control was applied.

After the biomass is added to the modified acid/peroxide blend (t=0s) the temperature rises very quickly with an average temperature increase of 0.74 K/min. When the reactor temperature reaches 35° C. 500 g of water is added quickly. Due to the heat release when water is added to an acid the temperature jumps up and then continues to rise with an average temperature increase of 0.30 K/min.

When the next addition temperature (37° C.) is reached, another 500 g of water is added to the reactor, and again the temperature jumps and then continues to rise at 0.14 K/min. The third and fourth water addition were carried out at 39° C. and 41° C. and resulted in average slopes of 0.071 K/min and 0.016 K/min respectively.

In the experiment with only three additions of water the reactor temperature rises up to 41.6° C. and then decreases again until the end of the reaction. In the experiment with only two additions of water, the maximum temperature is 45.5° C. This comes very close to a self-imposed safety limit of 50° C. at which point external reactor cooling would have been switched on to prevent any possible runaway reaction. It is desirable to avoid runaway reactions as they may result in the generation of carbon black residue from the initial biomass.

According to a preferred embodiment of the present invention, the temperature increase should be below 0.14 K/min to stay within safe working conditions. External cooling of a large-scale reactor is very energy intensive and therefore expensive.

Preferably, it is advantageous to run a biomass delignification with modified acid/peroxide blends without external cooling as this lowers the input costs of performing delignification. According to a preferred embodiment of the present invention, the process can be regulated by controlling the temperature increase after biomass addition with addition of water alone. By determining the minimum amount of water that needs to be added, the process can be run both safely as well as efficiently. In the experiments carried out all of the cellulose resulting batches had kappa numbers below 4.2.

Figure 4:
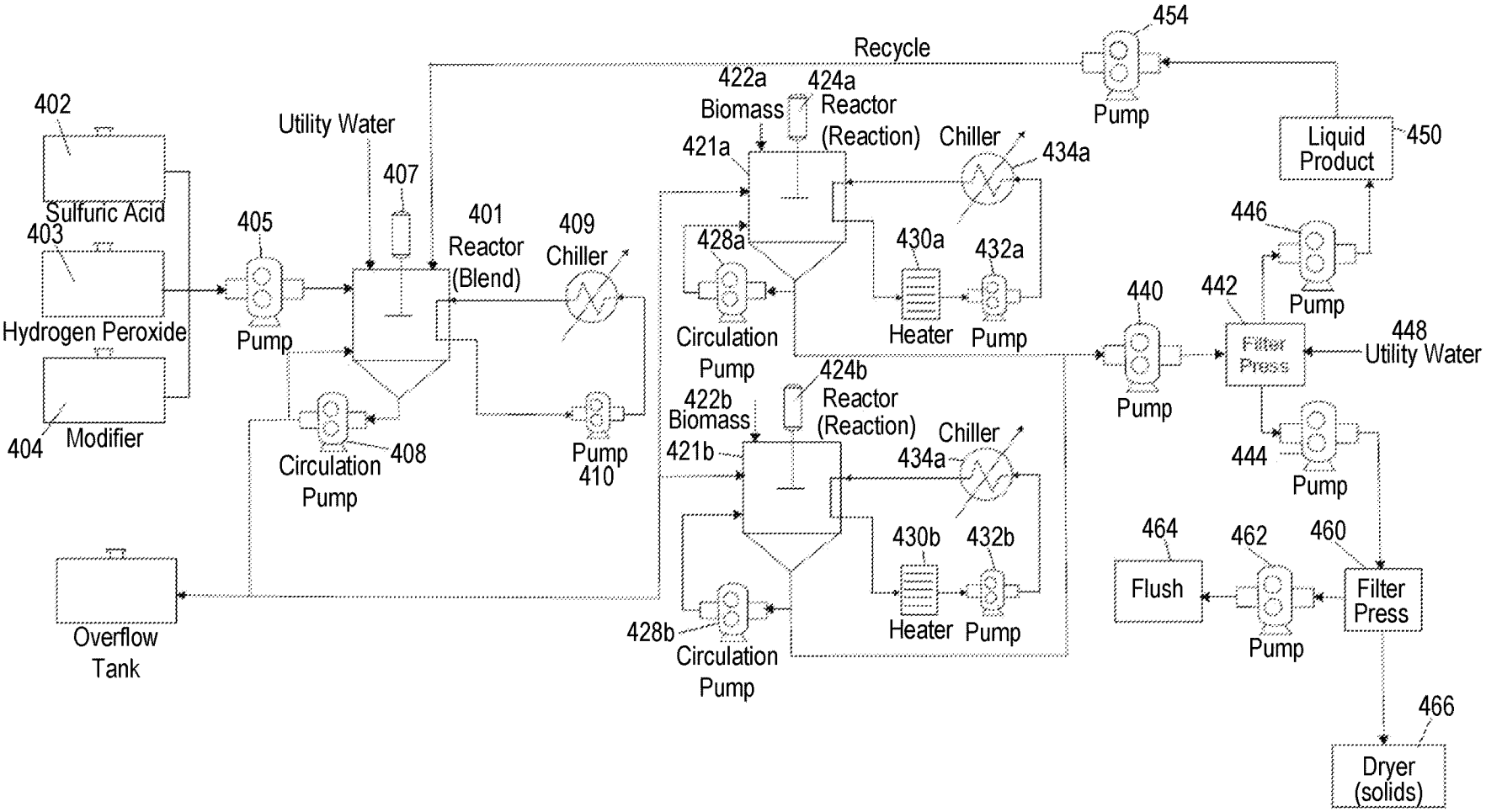
FIG. 4 shows a diagram set-up of a scaled-up process according to a preferred embodiment of the present invention comprising two reaction vessels.

As illustrated in FIG. 4, the process according to a preferred embodiment of the present invention provides for a mixing vessel (401) which is fed with an acidic composition comprising sulfuric acid, hydrogen peroxide and a modifier contained in separate tanks (402, 403, 404 respectively) through actuation of pump (405). The mixing vessel (401) contains a mixer (407) which, in cooperation with a recirculation pump (408), mixes the individual components which makes up the modified acid composition to enable the delignification reaction to occur. Once throroughly mixed using a mixer (407) and a recirculation pump (408), the modified acid composition is sent to two separate reactor vessels (421*a* and 421*b*) where it is combined with the biomass (422*a* and 422*b*) and the delignification reaction is carried out. The modified acid composition mixing vessel (401) also includes, within its proximity, a pump (410) to allow the modified acid to be recirculated through a chiller (409) and back into the mixing vessel (401).

Each of said reactor vessels (421*a* and 421*b*) is equipped with a system comprising a mixer (424*a* and 424*b*), a recirculation pump (428*a* and 428*b*) and a heat exchange loop comprising a heater (430*a* and 430*b*), a pump (432*a* and 432*b*) and a chiller (434*a* and 434*b*). The heat exchange loop allows the operator to increase the reaction temperature to the desirable temperature to achieve the optimal reaction rate but also to cool down the reaction mixture (comprising the biomass and the modified acid composition and water, where necessary) to control the temperature thereof and maintain it within the desired range. In the event, that the reaction vessel (421*a* and 421*b*) (comprising the biomass and the modified acid composition) is made of a polymer (such as HDPE) it is desirable to control the temperature of the reaction mixture so as to prevent the degradation of the polymeric vessel. In the event thart the vessel is made of stainless steel the temperature control remains necessary but for different reasons. Controlling the reaction temperature and maintaining it below the temperature where some of the lignin breakdown products can volatilize (escape as vapor product) is desirable both to prevent loss of product (lignin breakdown compounds) from the delignification reaction but also to keep the area where such systems are set up free of potentially flammable vapours. Preferably, when using HDPE reaction vessels, it is desirable to control the reaction temperature and maintain it below 50° C. Preferably, when using stainless steel reaction vessels, it is desirable to control the reaction temperature and maintain it below 70° C. It is also desirable to maintain the temperature range at 30-45° C. to achieve at least 90% delignification and avoid potential oxidation of the valuable organic compounds which occurs

TABLE 1

Slopes of temperature curves for each experiment according to a preferred embodiment of the present invention

| K/min | 4 additions (#1) | 4 additions (#2) | 4 additions (#3) | 3 additions | 2 additions | Average |
|---|---|---|---|---|---|---|
| Slope 1 | 0.789 | 0.627 | 0.808 | 0.727 | 0.763 | 0.742 |
| Slope 2 | 0.330 | 0.243 | 0.345 | 0.266 | 0.324 | 0.302 |
| Slope 3 | 0.168 | 0.115 | 0.167 | 0.126 | 0.144 | 0.144 |
| Slope 4 | 0.084 | 0.056 | 0.084 | 0.061 | n/a | 0.071 |
| Slope 5 | 0.024 | 0.002 | 0.023 | n/a | n/a | 0.016 |
| Kappa # | 1.72 | 4.17 | 3.36 | 3.35 | 2.35 | |

above 55° C. and moreover, to avoid reaching the run away temperature of 57° C. which makes temperature control more difficult.

Upon completion of the delignification reaction, the resulting misture is sent to a filter press (442) where water (448) may be injected into the resulting product to help in the separation process. The filter press (442) will separate most of the liquid portion from the solids portion and will send the liquid portion to a liquid product capture vessel (450) where the liquid can be further processed to separate out the remaining reaction chemicals and send them back through a pump (454) to the mixing vessel (401). The solids portion discharged form the filter press (442) is further processed through a second filter press (460) via pump (444). The second filter press (444) yields a liquid portion which is pumped through pump (462) to a holding vessel (464) for further processing while the solids portion can then be sent to a dryer (466). In some instances, where the cellulose solids need to remain partially wet, the drying stage is not employed. There may be a number of uses for a cellulose product which does not undergo drying and so, the use of a "wet" cellulose product further minimizes the energy footprint versus a conventional pulp which is dried prior to shipping for future uses.

Figure 5:
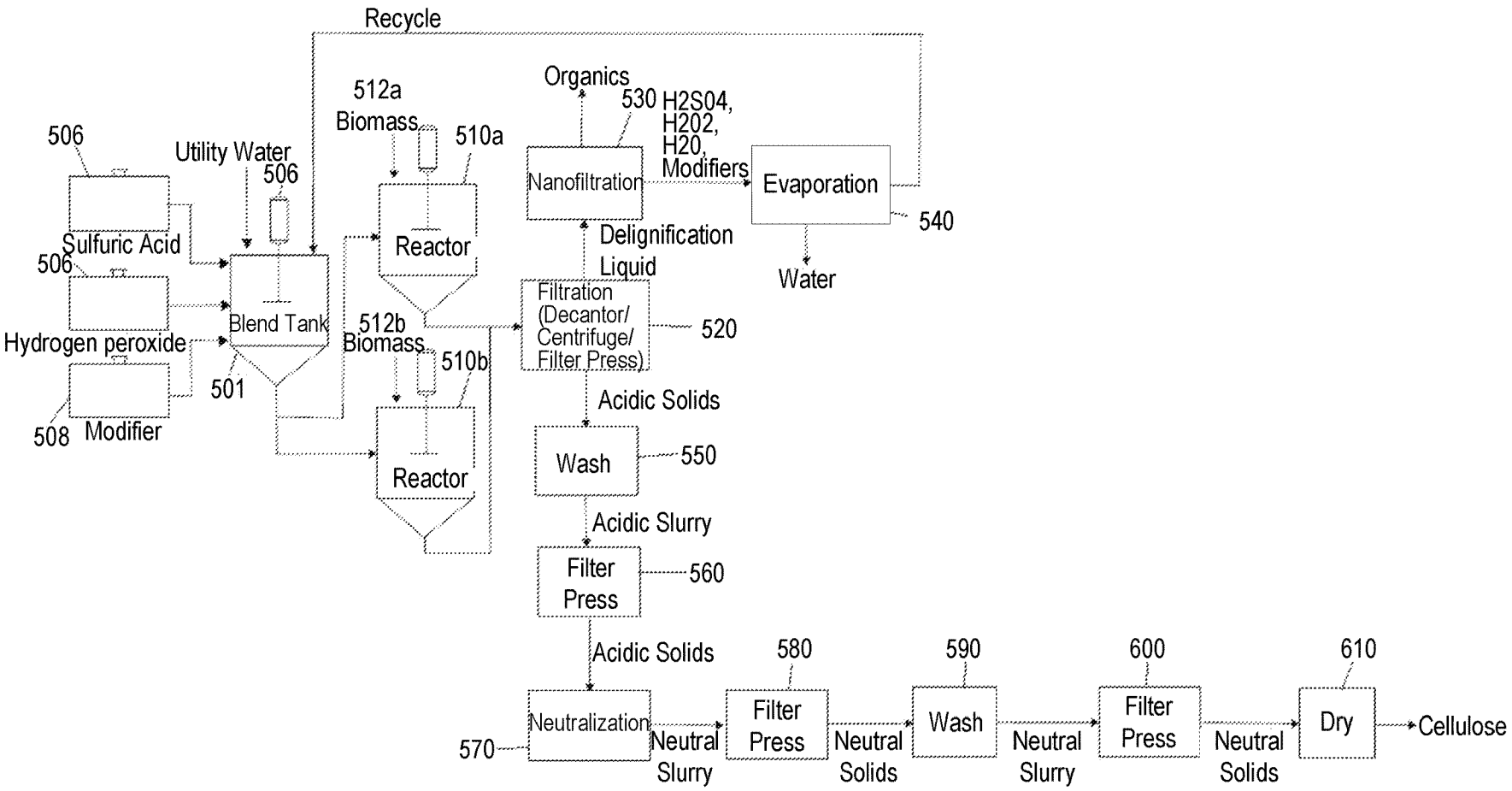
FIG. 5 shows a diagram set-up of a scaled-up process according to a preferred embodiment of the present invention comprising a flow diagram of post-delignification steps.

As illustrated in FIG. 5, the process according to a preferred embodiment of the present invention provides for a set-up capable of yielding 5 metric tons of cellulose per day. The system comprises a mixing vessel (501) which is fed with an acidic composition comprising sulfuric acid, hydrogen peroxide and a modifier contained in separate tanks (504, 506, 508 respectively). The blend tank also called mixing vessel (501) contains a mixer (503) which mixes the individual components which makes up the modified acid composition to enable the delignification reaction to occur. Once throroughly mixed, the modified acid composition is sent to two separate reactor vessels (510*a* and 510*b*) where it is combined with the biomass (512*a* and 512*b*) and the delignification reaction is carried out.

Upon completion of the delignification reaction, the resulting misture is sent to a filtration unit (520). In the filtration unit (520) one or more of the following may occur in order to separate the solids portion from the liquid portion: decantation; centrifugation and filter pressing. The resulting separation occurring at the first filtration unit (520) will yield a liquid stream which is sent to a nanofiltration step (530). At the nanofiltration step (530), the various organic compounds extracted during delignification are removed from the sulfuric acid, peroxide, water and modifiers, the delignification blend of chemicals. The delignification blend is then sent to an evaporation unit (540) to remove the water present in the blend. Once the water has been removed, the chemicals can be recycled and reused into mixing vessel (501) for a future delignification reaction.

The solids portion is sent to a wash step (550) where the residual chemicals are removed from the solids. The residual chemicals can be sent to the nanofiltration unit (530) for further separation. The resulting strem from the wash step (550) is a slurry which is sent to a filter press (560) where more liquid is removed. The resulting stream from the filter press (560) is a stream of acidic solids which undergo a neutralization step (570). The resulting product from the neutralization press (570) is a neutralized slurry which undergoes another filter press step (580). The resulting neutralized solids undergo another wash step (590) to become a neutralized slurry which undergoes another filter press step (600) and yields product having a solids content which can range between 25 and 25% solids content. The resulting neutralized solids can be dried in a drying step (610).

Figure 6:
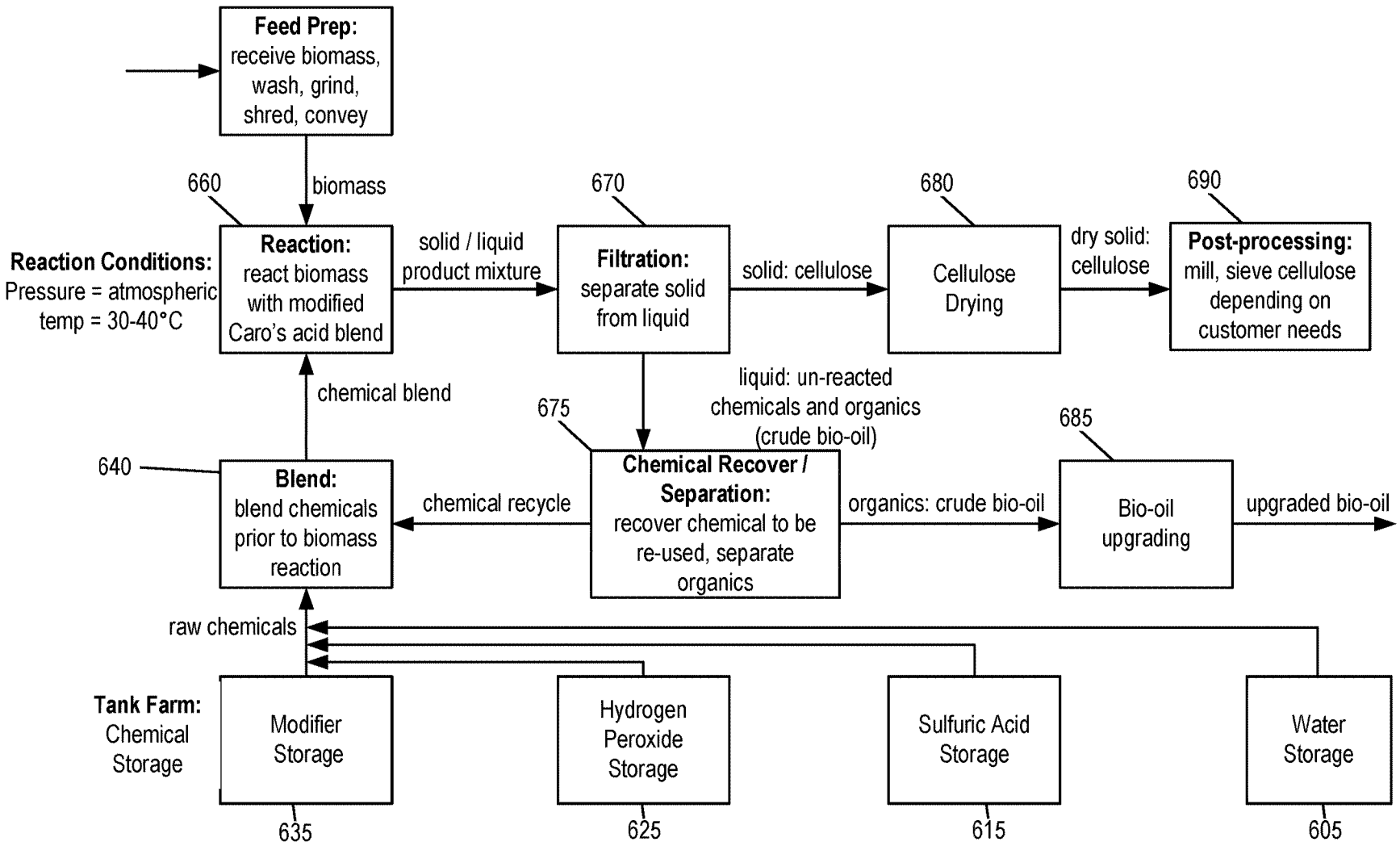
FIG. 6 shows a flow diagram of a process to delignify biomass material according to a preferred embodiment of the present invention comprising a flow diagram of post-delignification steps.

Illustrated in FIG. 6 is a flow diagram of the process steps according to a preferred embodiment of the present invention. The blend of the various chemicals and water is performed at 640. This includes the combining of: a modifier from a tank (or storage) (635) holding same; hydrogen peroxide from a tank (or storage) (625) holding same; sulfuric acid from a tank (or storage) (615) holding same; and water from a water storage (605). Once the modified acid is blended, it is transferred to a vessel where it will be combined with the biomass (which underwent a feed preparation stage (650) to form a reaction mixture (660). The reaction is carried out at a pre-determined temperature, preferably in the range of 30 to 40° C. under atmospheric pressure until a desirable point of delignification has been achieved. At this point, the mixture is transferred to undergo a filtration step (670) which will separate the solids portion from the liquids portion. The solids portion undergoes a drying step (680) to yield a dry solid: cellulose. The solid cellulose may undergo other treatment steps in post-processing (690) such as milling, sieving and the like in order to achieve a desirable particle size according to a customers specifications. The liquid will undergo a recovery stage and a separation stage (675) where the chemicals making up the modified acid are separated from the rest of the liquid and recycled to the blend making step (640). The remaining liquid which mainly contains the crude organic compounds are the basic components of bio-oil which will undergo an upgrading step (685) to yield an upgraded bio-oil.

Experiments

A series of experiments using a modified caro's acid composition in the delignification of biomass according to a preferred embodiment of the process of the present invention were carried out. The conditions of each experiment and kappa # of the resulting cellulose is listed in table 2 where the experiments were carried out using sulfuric acid ($H_2SO_4$); hydrogen peroxide ($H_2O_2$); triethanolamine (TEOA); and methanesulfonic acid (MSA) as well as water ($H_2O$). Three different feedstock types i.e., Kiln dry Wood, Soft Wood and Corn Stover were tested. The relationship between the hydrogen peroxide ($H_2O_2$) consumption versus and amount of cellulose produced was also studied for the purpose of optimizing the $H_2O_2$ used in the process. The optimization of $H_2O_2$ consumption was directly linked and evaluated by the final Kappa number as a quality measure of the resulting cellulose.

TABLE 2

Various experimental conditions used to carry delignification on various biomass materials and the resulting kappa number of the cellulose obtained therefrom

| Experiment | Blend | Blend type | biomass | Blend Mass (kg) | Biomass loading (%) | Starting T (° C.) | Kappa # | Kg of $H_2O_2$ per kg of cellulose |
|---|---|---|---|---|---|---|---|---|
| 001 | $H_2SO_4$:$H_2O_2$:TEOA:MSA:$H_2O$ 10:10:1:1:20 | Fresh | KDW | 907 | 3.0 | 13 | 6.24 | 0.411 |
| 002 | $H_2SO_4$:$H_2O_2$:TEOA:MSA:$H_2O$ 10:10:1:1:20 | Fresh | KDW | 907 | 3.0 | 15.3 | 3.75 | 0.651 |

TABLE 2-continued

Various experimental conditions used to carry delignification on various biomass materials and the resulting kappa number of the cellulose obtained therefrom

| Experiment | Blend | Blend type | biomass | Blend Mass (kg) | Biomass loading (%) | Starting T (° C.) | Kappa # | Kg of $H_2O_2$ per kg of cellulose |
|---|---|---|---|---|---|---|---|---|
| 003 | $H_2SO_4$:$H_2O_2$:TEOA:MSA:$H_2O$ 10:10:1:1:20 | Fresh | KDW | 907 | 3.0 | 21.3 | 2.44 | 0.853 |
| 004-1 | $H_2SO_4$:$H_2O_2$:TEOA:MSA:$H_2O$ 10:10:1:1:20 | Fresh | KDW | 1297 | 5.0 | 20 | 2.25 | 0.837 |
| 004-2 | $H_2SO_4$:$H_2O_2$:TEOA:MSA:$H_2O$ 10:10:1:1:20 | Recycled + top up | KDW | 1297 | 5.0 | 18.5 | 3.57 | 0.842 |
| 004-3 | $H_2SO_4$:$H_2O_2$:TEOA:MSA:$H_2O$ 10:10:1:1:20 | Recycled + top up | KDW | 1297 | 5.0 | 22.4 | 5.46 | 0.735 |
| 004-4 | $H_2SO_4$:$H_2O_2$:TEOA:MSA:$H_2O$ 10:10:1:1:20 | Recycled + top up | KDW | 1297 | 5.0 | 23.2 | 9.31 | 0.776 |
| 004-5 | $H_2SO_4$:$H_2O_2$:TEOA:MSA:$H_2O$ 10:10:1:1:20 | Recycled + top up | KDW | 1297 | 5.0 | 22.9 | 14.61 | 0.616 |
| 005 | $H_2SO_4$:$H_2O_2$:TEOA:MSA:$H_2O$ 10:10:1:1:20 | Fresh | KDW | 1297 | 3.2 | 19.9 | 2.38 | 0.734 |
| 005-1 | $H_2SO_4$:$H_2O_2$:TEOA:MSA:$H_2O$ 10:10:1:1:20 | Recycled | KDW | 1004 | 5.0 | 22.9 | 2.21 | NA |
| 006 | $H_2SO_4$:$H_2O_2$:TEOA:MSA:$H_2O$ 10:10:1:1:20 | R*1 + top up | KDW | 1419 | 5.0 | 24 | N/A | 0.939 |
| 006-1 | $H_2SO_4$:$H_2O_2$:TEOA:MSA:$H_2O$ 10:10:1:1:20 | R*2 + top up | KDW | 1458 | 5.0 | 23.9 | N/A | 1.167 |
| 006-2 | $H_2SO_4$:$H_2O_2$:TEOA:MSA:$H_2O$ 10:10:1:1:20 | R*3 + top up | KDW | 1548 | 6.0 | 23.5 | N/A | 1.101 |
| 006-3 | $H_2SO_4$:$H_2O_2$:TEOA:MSA:$H_2O$ 10:10:1:1:20 | R*4 + top up | KDW | 1560 | 7.0 | 24.5 | 4.14 | 0.841 |
| 006-4 | $H_2SO_4$:$H_2O_2$:TEOA:MSA:$H_2O$ 10:10:1:1:20 | R*5 + top up | KDW | 1560 | 8.0 | 23.2 | 3.47 | 0.831 |
| 006-5 | $H_2SO_4$:$H_2O_2$:TEOA:MSA:$H_2O$ 10:10:1:1:20 | R*6 + top up | KDW | 1560 | 8.0 | 14.2 | N/A | N/A |
| 007 | $H_2SO_4$:$H_2O_2$:TEOA:MSA:$H_2O$ 10:10:1:1:20 | R*7 + top up | KDW | 1592 | 6.0 | 26.8 | 3.22 | 0.882 |
| 007-1 | $H_2SO_4$:$H_2O_2$:TEOA:MSA:$H_2O$ 10:10:1:1:20 | R*8 + top up | KDW | 1614 | 6.0 | 25.4 | 2.55 | 0.961 |
| 007-2 | $H_2SO_4$:$H_2O_2$:TEOA:MSA:$H_2O$ 10:10:1:1:20 | R*9 + top up | KDW | 1614 | 6.0 | 21.9 | 2.48 | 1.257 |
| 007-3 | $H_2SO_4$:$H_2O_2$:TEOA:MSA:$H_2O$ 10:10:1:1:20 | R*10 + top up | KDW | 1614 | 6.0 | 27.2 | 2.28 | 3.411 |
| 008 | $H_2SO_4$:$H_2O_2$:TEOA:MSA:$H_2O$ 10:10:1:1:15 | Fresh | Corn stover | 1310 | 5.0 | 20.7 | 3.56 | 1.849 |
| 009 | $H_2SO_4$:$H_2O_2$:TEOA:MSA:$H_2O$ 10:10:1:1:20 | Fresh | WF old chips | 650 | 5.0 | 27.6 | 1.96 | 0.996 |
| 009-1 | $H_2SO_4$:$H_2O_2$:TEOA:MSA:$H_2O$ 10:10:1:1:20 | Recycled (562 kg of blend 009) | WF old chips | 562 | 5.0 | 28.4 | 1.93 | 1.540 |
| 010 | $H_2SO_4$:$H_2O_2$:TEOA:MSA:$H_2O$ 10:10:1:1:4 | Fresh | WF old chips | 795 | 5.0 | 27.4 | 2.77/ 4.43 | 1.617 |
| 010-1 | $H_2SO_4$:$H_2O_2$:TEOA:MSA:$H_2O$ 10:10:1:1:4 | Recycled (470 kg of blend 010) | WF old chips | 470 | 5.0 | 23.2 | 5.12 | 1.636 |
| 010-2 | $H_2SO_4$:$H_2O_2$:TEOA:MSA:$H_2O$ 10:10:1:1:4 | R*11 | WF old chips | 460 | 5.0 | 29.1 | 2.1 | 1.871 |

Where: KDW stands for Kiln dried wood; WF stands for West Fraser; R*1 means recycle ~500 kg of blend 005-1; R*2 means recycle ~1085 kg of blend 006; R*3 means recycle ~1185 kg of blend 006-1; R*4 means recycle ~1036 kg of blend 006-2; R*5 means recycle ~1100 kg of blend 006-3; R*6 means recycle ~1370 kg of blend 006-4; R*7 means recycle ~604 kg of blend 005-1 and 006-4; R*8 means recycle ~900 kg of blend 007; R*9 means recycle ~900 kg of blend 007-1; R*10 means recycle ~900 kg of blend 007-2; and R*11 means recycle ~460 kg of blend 010 and 010-1.

The molar ratio of chemicals, $H_2SO_4$:$H_2O_2$:TEOA:MSA employed was 10:10:1:1. This was found to provide a good delignification while being a very safe blend for the operator. The experiments were carried out for a duration of approximately 24 hours. In most cases, the consumption of the peroxide component was less than 25% of the total peroxide present in the reaction blend. Thus, in the experiments where a lop-up' was performed, only at most 25% of the peroxide had to be replenished. It is worth noting that adding water to the blend was necessary as the biomass (in some cases) was kiln dried wood, which has a very low moisture content. In the event, the biomass processed was different such as West Fraser wood chips (higher moisture content) the amount of water added to the blend was lessened.

Figure 7:
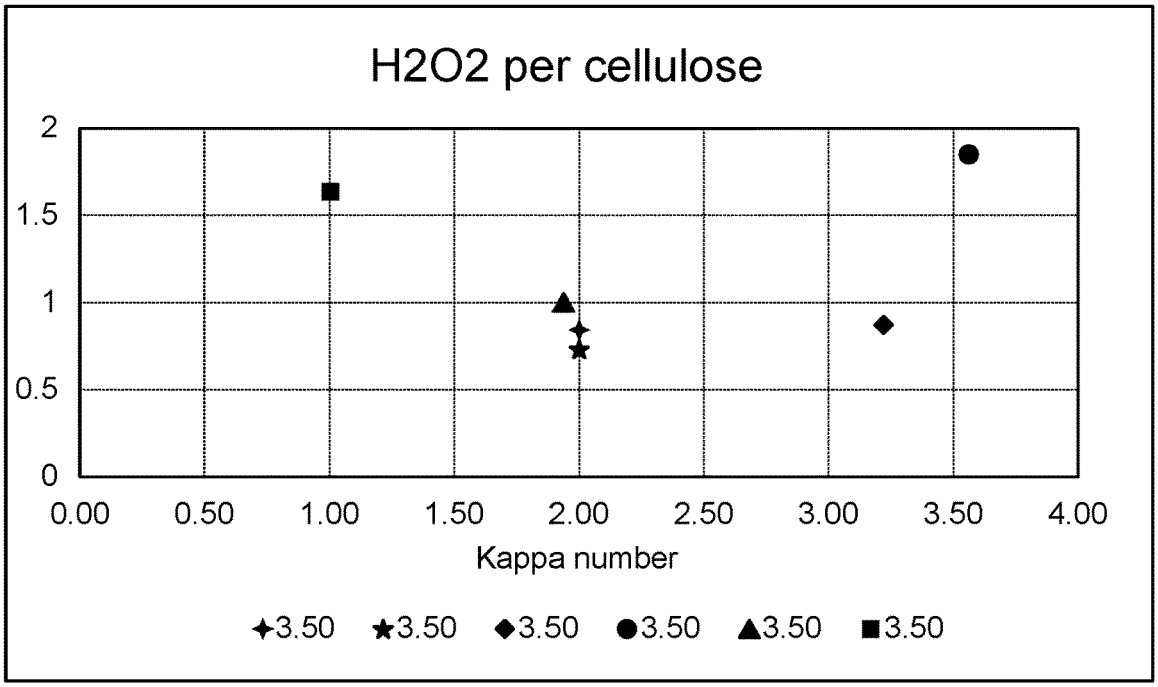
FIG. 7 is a graphical representation of the ratio of peroxide (H2O2) consumed/amount of cellulose produced versus Kappa number.
Figure 8:
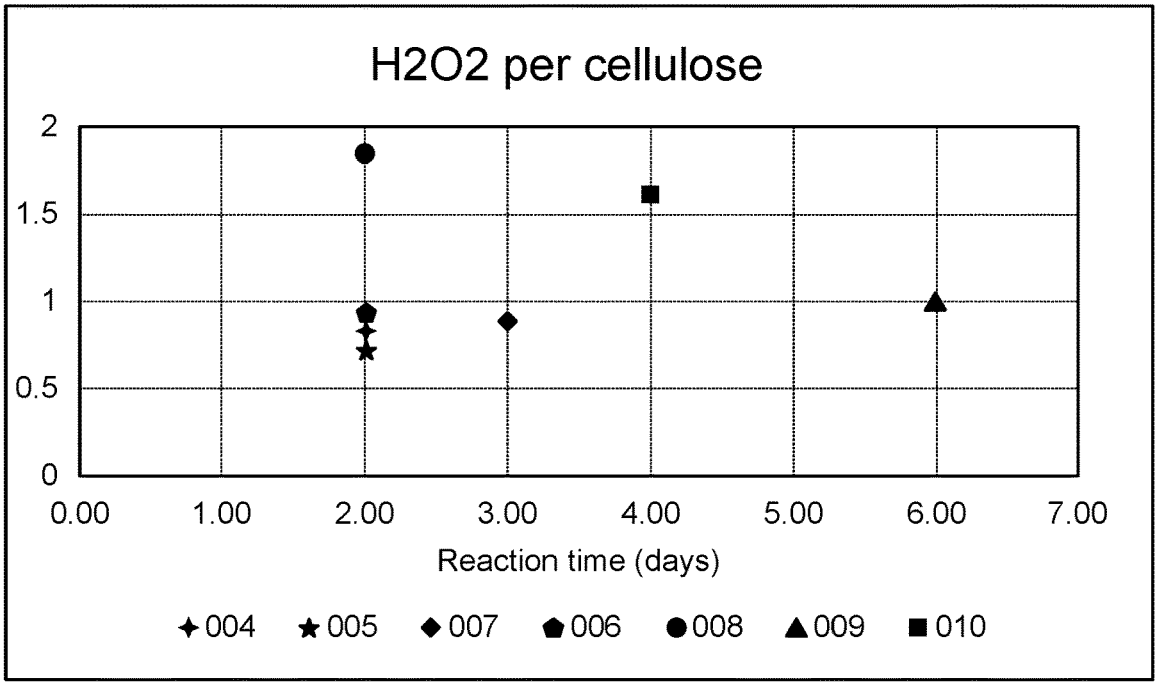
FIG. 8 is a graphical representation of the ratio of peroxide (H2O2) consumed/amount of cellulose produced versus reaction time for a number of delignification reaction according to the present invention.

FIG. 7 and FIG. 8 show the ratio of peroxide ($H_2O_2$) consumed and amount of Cellulose produced versus the change in Kappa number and reaction time for a number of experiments. One of the most important finding from those experiments is that the resulting cellulose having a Kappa number of 2 was achieved in a single reactor run in comparison to the traditional multi-step pulping process. It is also noteworthy to point out that a Kappa number of 2 indicates a near complete delignification and often times occurs when the average ratio of peroxide ($H_2O_2$) consumed and amount of Cellulose produced is approximately 0.9.

A valuable approach to optimize the hydrogen peroxide ($H_2O_2$) consumption is the recycling of the reaction blend after each reaction and removal of the solid cellulose by filtration. This is performed and is highly advantageous to do so since only 20% of the hydrogen peroxide ($H_2O_2$) added to the blend is consumed. Hence, recycling the blend, having a high quantity of unreacted peroxide component after the separation of the resulting cellulose substantially reduces the overall peroxide ($H_2O_2$) consumption.

According to a preferred embodiment of the present invention, good control of the reaction temperature is one of the factors in driving the delignification reaction forward which indicates that the reaction is kinetically driven. Other experiments demonstrate that a delignification reaction time of 3 hours is achieved. Those experiments carried out in a temperature ranging from 30 to 45° C. show that the desired delignification is achieved without impacting the hydrogen peroxide ($H_2O_2$) consumption and the resulting cellulose's kappa number.

According to a preferred embodiment of the present invention, the reaction temperature is in the range of 30 to 45° C. since it not only provides consistent Kappa numbers in the resulting cellulose, it also provides a consistent lignin-hemicellulose-depolymerized-organic (LHDO) mixture. It also preserves the LHDO from potential oxidation by the hydrogen peroxide ($H_2O_2$). Preferably, the produced LHDO is separated from cellulose through filtration and purified from Sulfuric acid using a nanofiltration process step with specific membrane design for this application which allows for a separation efficiency of greater than 90%. This provides a unique organic stream that can be easily upgraded to a high value renewable fuel.

While the foregoing invention has been described in some detail for purposes of clarity and understanding, it will be appreciated by those skilled in the relevant arts, once they have been made familiar with this disclosure that various changes in form and detail can be made without departing from the true scope of the invention in the appended claims.

What is claimed is:

1. A process to perform a controlled exothermic delignification of biomass, said process comprising the steps of:
- providing a vessel;
- providing biomass comprising lignin, hemicellulose and cellulose fibers into said vessel;
- providing a modified Caro's acid composition selected from the group consisting of: composition A and Composition C;
  - wherein said composition A comprises:
    - sulfuric acid in an amount ranging from 20 to 70 wt % of the total weight of the modified Caro's acid composition;
    - a compound comprising an amine moiety and a sulfonic acid moiety selected from the group consisting of: taurine; taurine derivatives; and taurine-related compounds; and
    - a peroxide,
    - wherein said sulfuric acid, said compound comprising an amine moiety and a sulfonic acid moiety, and said peroxide are present in a molar ratio of no less than 1:1:1 and no more than 15:1:1;
  - wherein said composition C comprises:
    - sulfuric acid;
    - a compound comprising an amine moiety;
    - a compound comprising a sulfonic acid moiety; and
    - a peroxide,
    - wherein said sulfuric acid and said a compound comprising an amine moiety, and said compound comprising a sulfonic acid moiety are present in a molar ratio of no less than 1:1:1 and no more than 28:1:1;
- exposing said biomass to said modified Caro's acid composition, creating a reaction mass;
- allowing said modified Caro's acid composition to come into contact with said biomass for a period of time sufficient to a delignification reaction to occur and remove over 90 wt % of said lignin and hemicellulose from said biomass; and
- controlling the temperature of the delignification reaction to maintain it below 55° C. by a method selected from the group consisting of:
  - adding water into said vessel;
  - adding biomass into said vessel; and
  - using a heat exchanger.

2. The process according to claim 1, wherein said compound comprising an amine moiety and a sulfonic acid moiety is selected from the group consisting of: taurine; taurine derivatives; and taurine-related compounds.

3. The process according to claim 1, where said taurine derivative or taurine-related compound is selected from the group consisting of: taurolidine; taurocholic acid; tauroselcholic acid; tauromustine; 5-taurinomethyluridine and 5-taurinomethyl-2-thiouridine; homotaurine (tramiprosate); acamprosate; and taurates; as well as aminoalkylsulfonic acids where the alkyl is selected from the group consisting of $C_1$-$C_5$ linear alkyl and $C_1$-$C_5$ branched alkyl.

4. The process according to claim 1, where said compound comprising an amine moiety and a sulfonic acid moiety is taurine.

5. The process according to claim 1, where said sulfuric acid and compound comprising an amine moiety and a sulfonic acid moiety are present in a molar ratio of no less than 3:1.

6. The process according to claim 1, where said compound comprising an amine moiety is an alkanolamine selected from the group consisting of: monoethanolamine; diethanolamine; triethanolamine; and combinations thereof.

7. The process according to claim 1, where said compound comprising a sulfonic acid moiety is selected from the group consisting of: alkylsulfonic acids and combinations thereof.

8. The process according to claim 1, where said compound comprising a sulfonic acid moiety is methanesulfonic acid.

9. A process to delignify biomass, said process comprising the steps of:
- providing a vessel;
- providing biomass comprising lignin, hemicellulose and cellulose fibers into said vessel;
- providing an aqueous acidic composition comprising:
  - a sulfuric acid component, and;
  - a peroxide component, wherein said sulfuric acid component and said peroxide component are present in a molar ration of no less than 1:1 and no more than 15:1;
- exposing said biomass to said aqueous acidic composition, creating a reaction mass;
- allowing said aqueous acidic composition to come into contact with said biomass for a period of time sufficient to a delignification reaction to occur and remove over 90 wt % of said lignin and hemicellulose from said biomass; and
- controlling the temperature of the delignification reaction by addition of water into said vessel to maintain the temperature below 55° C.

10. The process according to claim 9 where the initial temperature of the reaction mass is no more than 25° C. and does not exceed 55° C. for the duration of the delignification reaction.

11. The process according to claim 9, where the temperature of the reaction mass is kept below 50° C. for the duration of the delignification reaction.

12. The process according to claim 9, where the temperature of the reaction mass is kept below 45° C. for the duration of the delignification reaction.

13. The process according to claim 9, where the temperature of the reaction mass is controlled throughout the delignification reaction to subsequent additions of a solvent (water) to progressively lower a slope of temperature increase per minute from less than 1° C. per minute to less than 0.5° C. per minute.

* * * * *